US005860535A

United States Patent [19]

Brown

[11] Patent Number: 5,860,535

[45] Date of Patent: Jan. 19, 1999

[54] SHELF RESTRAINT

[76] Inventor: Nacio Jan Brown, 1814-7th St., Berkeley, Calif. 94710

[21] Appl. No.: 24,390

[22] Filed: Feb. 17, 1998

[51] Int. Cl.[6] ..... A47B 65/00

[52] U.S. Cl. ..... 211/42; 211/43; 211/184

[58] Field of Search ..... 211/42, 43, 105.3; 108/60, 61

[56] References Cited

U.S. PATENT DOCUMENTS

| | | | |
|---|---|---|---|
| 202,959 | 4/1878 | Pearson | 211/42 X |
| 3,165,204 | 1/1965 | Spencer | 211/42 |
| 4,637,632 | 1/1987 | Rubash et al. | 211/42 X |
| 5,036,988 | 8/1991 | Rouire | 211/42 |
| 5,038,689 | 8/1991 | Duffy | 211/42 X |
| 5,119,948 | 6/1992 | Hallgimsson | 211/42 X |
| 5,181,622 | 1/1993 | Hallgrimsson | 211/42 X |
| 5,533,630 | 7/1996 | Chen | 211/42 X |

*Primary Examiner*—Daniel P. Stodola
*Assistant Examiner*—Erica B. Harris
*Attorney, Agent, or Firm*—Linval B. Castle

[57] ABSTRACT

A shelf restraint for holding books and other objects on a shelf in the event of an earthquake comprises a pair of identical bookends on the shelf, each with a deep central slot into which a rod is pivoted to form a gate spanning the space between the bookends. The gate is easily lifted for removal of a book and drops to a position near the center of the bookend for retaining the books.

7 Claims, 2 Drawing Sheets

SHELF RESTRAINT

This invention relates to shelf restraints and in particular to a restraint including a horizontal bar that pivots down to temporarily block the removal of the items from a shelf during earthquakes.

BACKGROUND OF THE INVENTION

In any area that is threatened by occasional earthquakes, it is important that items that are normally stored on shelves remain on the shelves during a quake. This applies to books in libraries and schools and also to bottled and canned goods in stores and in the pantry. A strong earthquake may empty many grocery shelves and result in a great loss to stores, and also may empty a library shelves resulting in costly restoration of the library and possibly an injury or loss of life to anyone browsing in the stacks.

It is therefore an object of the invention to provide a temporary gate that pivots down in front of the items on the shelf to prevent the items from being shaken from the shelf and which may be readily lifted for removal of an item.

It is an important object of the invention to provide a shelf restraint that may be easily added to an existing shelf while requiring a minimum of shelf space.

It is still another object of the invention to provide a shelf restraint that is suspended between bookends and which may occupy only a portion of a shelf.

These and other objects and advantages will become apparent in reading the specifications.

SUMMARY OF THE INVENTION

The shelf restraint comprises a metal bar that normally rests horizontally just forward of the bound edges of books, or the like, on a bookshelf. The bar is pivotally connected, at each end, to a slot in the bookend between two side surfaces that have smooth exterior surfaces, thereby presenting a smooth surface to abutting books on the shelf and also protecting the pivoting bar. The two bookends are preferably fastened to the shelf with double-coated adhesive tape and may be located in any position along a shelf in order to protect items on portions of the shelf. Thus, the restraint could protect a stack of phonograph records or CDs on half of the shelf and leave the remainder for unbreakable items. Or the restraint could cover an entire library bookshelf. The removal of a single book is easily accomplished by merely lifting the pivoted bar extending between the bookends.

BRIEF DESCRIPTION OF THE DRAWINGS

In the drawings that illustrate the preferred embodiment of the invention.

DETAILED DESCRIPTION

Figure 1:
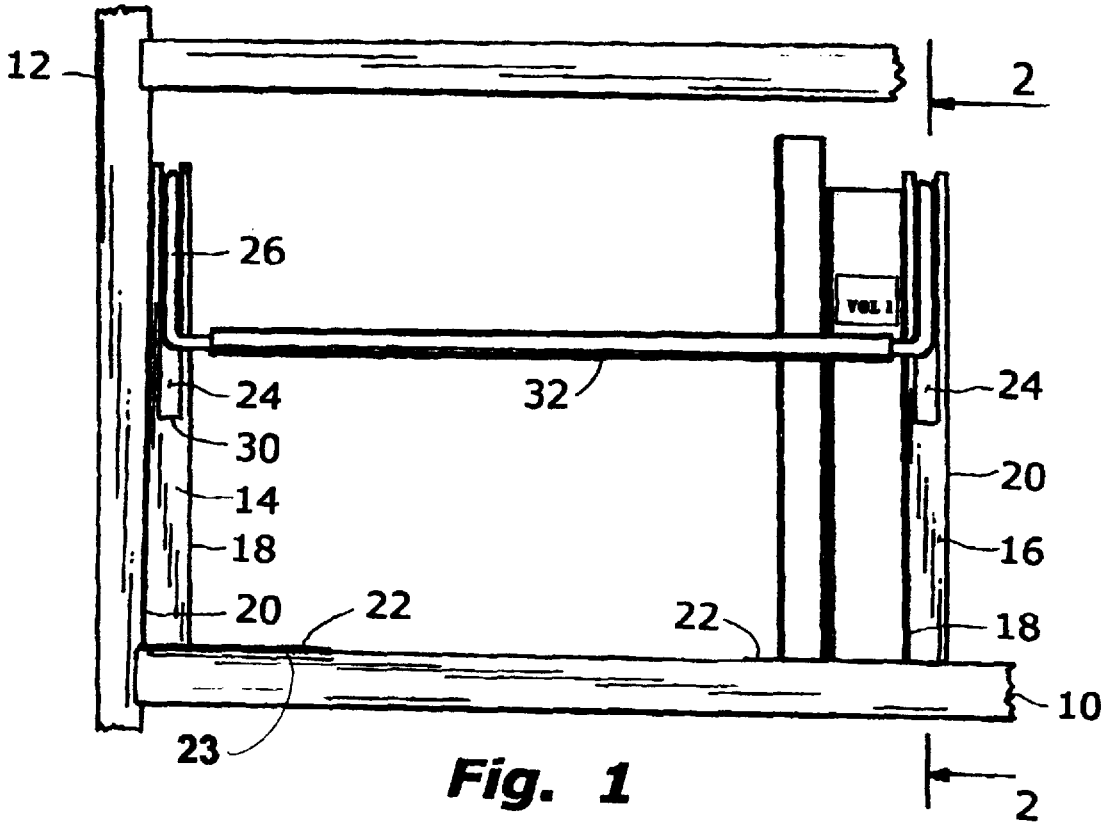
FIG. 1 is a front elevational view illustrating the invention.

The shelf restraint is illustrated in FIG. I occupying part of a shelf 10 of a bookcase 12 to restrain several books while the remainder of the shelf is used for storage of other items. The restraint includes the bookends 14, 16 which have smooth vertical walls 18, 20 and horizontal plates 22 attached to the bottom for securing the bookends by the weight of the books standing on the plates and held with double-sided adhesive tape.

The bookends 14, 16 are identical but are mirror images of each other, each is preferably rectangular, approximately book sized or the height of the items to be restrained, and formed with a deep central slot 24 in the top edge that extends down about half the height of the bookend. The width of the slot 24 may be about 5/16 inches so that a ¼ inch rod 26 may pivot freely within it. The bookends may be formed of plastic or metal with an overall thickness of about ½ inch, or they may be formed of wood or ceramic.

The reason for the deep slot 24 is to display two smooth side surfaces so that adjacent books and other items on a shelf will not contact the movable rods 26 attached to the bookends. If the shelf restraint is to be permanently used on the end of a shelf abutting a vertical shelf member, there is no need for the horizontal bottom plate 22 and the bookend may be secured to the vertical shelf member.

Figure 2:
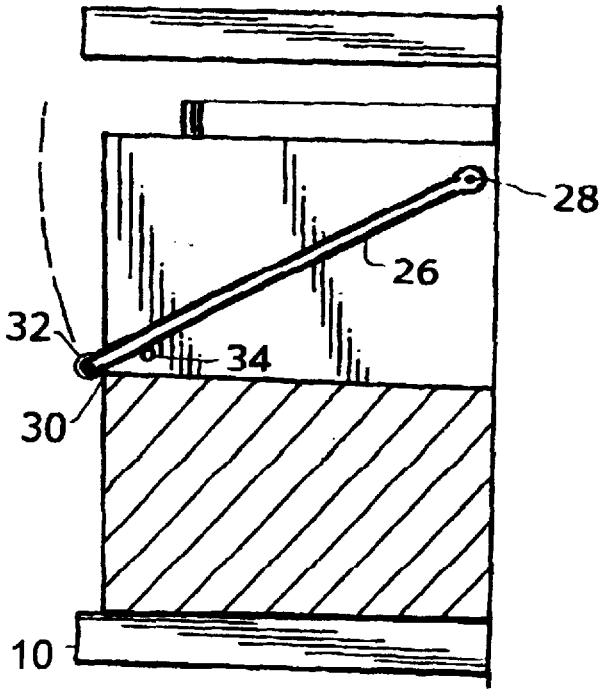
FIG. 2 is side elevational view taken along the lines 2—2 of FIG. 1.

The ¼ inch rod 26 is bent into a simple right-angled crank and attached to the interior walls of the slot 24 at a pivot point 28 that is near the top edge at the rear of the slot, as shown in the side sectional view, FIG. 2. From the pivot point 28, the rod 26 extends through the slot 24 to the junction 30 of the front face of the bookends 14, 16 and the edge of the slot 24 where the rod is bend into a right-angle. The rod 26 is cut off approximately three inches from the junction 30 and is inserted into a tubing 32 of an inside diameter that fits the diameter of the rod 26 and desired length to span between the bookends 14 and 16, as shown in FIG. 1. It is preferred that the tubing 32 closely fits around the ends of the rod 26 to eliminate play between tubing and rod and so that the tubing will remain horizontal as it is lifted. But a loose connection between tubing and rod is acceptable if it is assured that the tubing is sufficiently long so that it cannot accidentally become disconnected from the rod.

Other forms of cranks may be used between the pivot point 28 and tubing 32. For example, a metal bar approximately ⅛ inches thick by ½ inch wide may replace the straight portion of the rod 26 and a short machine screw through the end would form the crank end that fits into the tubing 32. With this form of crank, narrower slots 24 are possible and, it follows, narrower bookends are possible.

If the bookends are formed of wood or other soft material, it may be desirable to protect the material from wear from the rod 26 hitting the wood at the junction 30 by adding a stop in the form of a metal pin 34 across the slot 24 as shown in FIG. 2.

To assemble the shelf restraint to a bookshelf, it is necessary to secure the bookends 14, 16 to the bookshelf 10. This is easily done by applying a small amount of double-coated adhesive tape 23 to the bottom surface of the horizontal plates 22 attached to the bookends. The first step is to attach one bookend, for example bookend 14. Then attach the tubing 32 to the crank ends of both the rods 26, and adhere the other bookend to the shelf 10. In those instances where the bookends each lie against a vertical end of a bookshelf, as shown in FIG. 3, the bookends may be secured to the vertical ends by adhering the adjoining bookend wall with double-coated adhesive tape 23.

Figure 3:
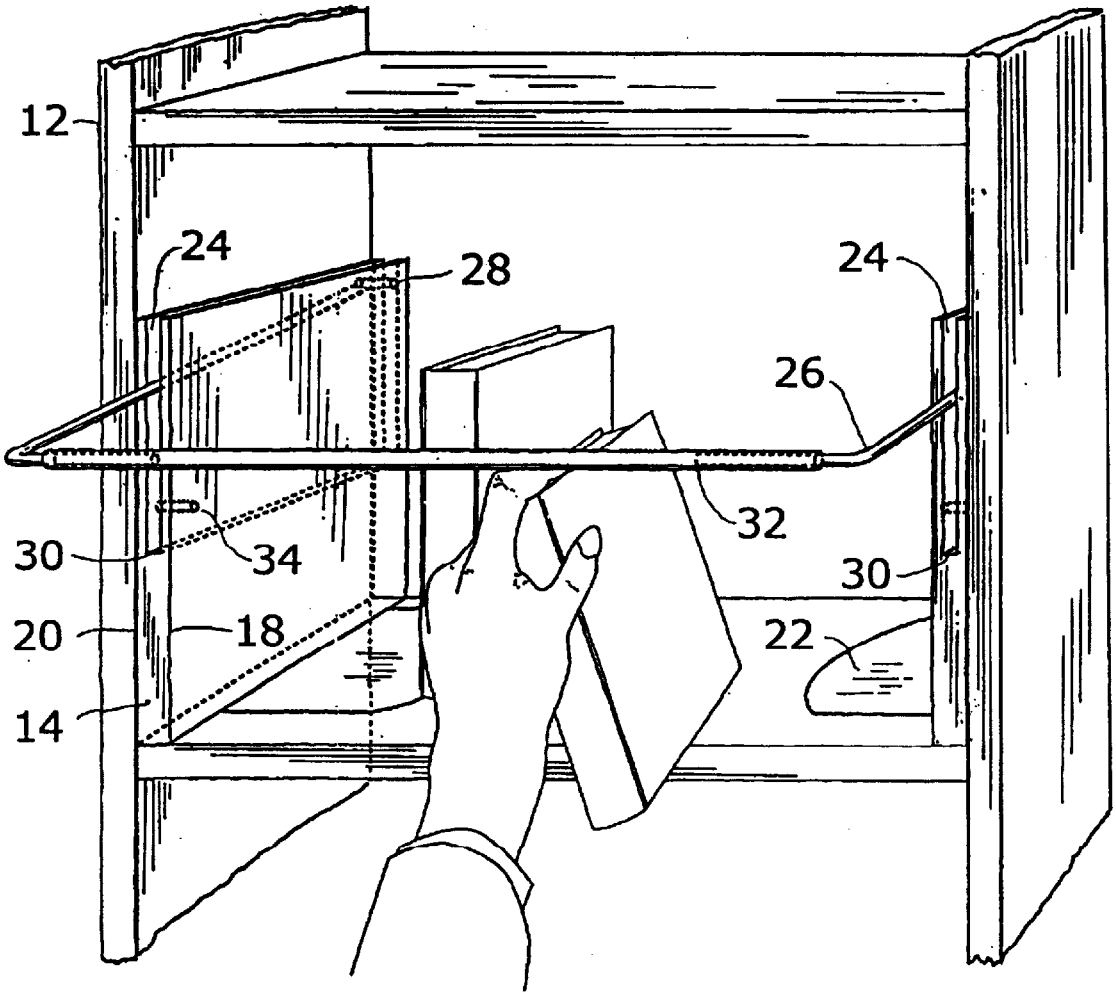
FIG. 3 is a perspective view of the invention used to restrain library books.

FIG. 3 is a perspective view of the shelf restraint in use. The horizontal tubing 32 normally rests at the level of the junction 30 of the bottom of the slot 24 with the face of the bookend. At this position the tubing 32 is firm and provides a strong restraint against shaking and vibrational forces that may be urging books and other items from the shelf To remove an item from the shelf, it is only necessary to lift the tubing 32, thereby pivoting the rods 26 about the pivot points 28, as shown in FIG. 2.

I claim:

1. A shelf restraint for preventing items from falling from a shelf, said shelf restraint comprising:

a pair of spaced parallel bookends, each bookend of said pair having a front, rear, top and bottom edge, the distance between the top and bottom edges being of a predetermined height so that items placed on the shelf would be restrained, each said bookend having smooth exterior walls and a deep central slot extending within each of said walls from said top edge to a depth approximately half the height of said bookend;

a crank having a body within the central slot in each bookend of said pair, said crank having a first end pivotally coupled to a pivot point located near the rear edge and the top edge of said bookend, said crank having a second end being at a right angle to the wall of said bookend, the second end of each crank in said pair of spaced parallel bookends facing each other;

a tubing spanning the distance between said spaced bookends, said tubing having an inside diameter sized to fit around the second ends of said cranks, said tubing engaging said second ends; and means for securing each one of said pair of bookend to a shelf.

2. The shelf restraint claimed in claim 1 further including a metal stop pin coupled within sidewalls of a bookend for limiting the pivoting of the crank in said slot.

3. The shelf restraint claimed in claim 1 wherein said means for securing a bookend to a shelf comprises adhering said bookend by double-coated adhesive tape.

4. The shelf restraint claimed in claim 1 wherein said means for securing a bookend to a shelf includes a horizontal plate attached to the bottom edge of said bookshelf, said plate being secured to a shelf with double-coated adhesive tape.

5. The shelf restraint for holding books on a bookshelf during earthquakes, said shelf restraint comprising:

a pair of bookends adapted to be placed on the bookshelf, said bookends being spaced apart and parallel, each bookend of said pair being thin and having at least one flat smooth side surface and a second surface opposite an upper half of said smooth side surface, the smooth side surface being adapted to be approximately the size and shape of a book with a top and bottom edge and a front and rear edge;

a crank pivotally attached to a pivot in said second surface of each bookend, said pivot located near the top edge and the rear edge of said second surface, said crank extending straight from said pivot to the approximate center of said front edge, the end of said crank then turning at a right angle in a direction toward said smooth side surface;

means spanning the distance between the cranks and coupled to the ends of said cranks in said pair of bookends; and means for securing each of said bookends to said bookshelf.

6. The shelf restraint claimed in claim 5 where said means spanning the distance is a metal tubing that fits over the end of each crank in said pair of bookends.

7. The shelf restraint claimed in claim 5 wherein said means for securing includes a small strip of double-coated adhesive tape.

* * * * *